US010896636B2

(12) United States Patent
Pyun et al.

(10) Patent No.: US 10,896,636 B2
(45) Date of Patent: Jan. 19, 2021

(54) DISPLAY APPARATUS

(71) Applicant: Samsung Display Co., Ltd., Yongin-Si (KR)

(72) Inventors: Kihyun Pyun, Gwangmyeong-si (KR); Hyeon-Do Park, Gwangmyeong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/840,837

(22) Filed: Apr. 6, 2020

(65) Prior Publication Data

US 2020/0234630 A1 Jul. 23, 2020

Related U.S. Application Data

(62) Division of application No. 15/945,263, filed on Apr. 4, 2018, now Pat. No. 10,650,721.

(30) Foreign Application Priority Data

Apr. 26, 2017 (KR) ..... 10-2017-0053943

(51) Int. Cl.
*G09G 3/20* (2006.01)
*G09G 3/36* (2006.01)

(52) U.S. Cl.
CPC ..... *G09G 3/2092* (2013.01); *G09G 3/3611* (2013.01); *G09G 3/3677* (2013.01);
(Continued)

(58) Field of Classification Search
CPC ..... G09G 2310/027; G09G 2310/0281; G09G 2310/0283; G09G 2310/0286;
(Continued)

(56) References Cited

U.S. PATENT DOCUMENTS

2008/0136756 A1 6/2008 Yeo et al.
2011/0050677 A1 3/2011 Tsai et al.
(Continued)

FOREIGN PATENT DOCUMENTS

EP 3046100 A1 7/2016
KR 1020140122628 A 10/2014
KR 1020160088465 A 7/2016

*Primary Examiner* — Hong Zhou
(74) *Attorney, Agent, or Firm* — Cantor Colburn LLP

(57) ABSTRACT

A display apparatus includes a display panel including a plurality of first gate lines, a first gate driver connected to first ends of the plurality of first gate lines, a second gate driver connected to second ends of the plurality of first gate lines, a feedback line connected adjacent to the first end of one of the plurality of first gate lines, and a gate delay sensing circuit connected to the feedback line. The gate delay sensing circuit includes a time-to-digital converter and a digital comparator. The time-to-digital converter converts an activation time of a feedback gate signal into a digital activation value. The feedback gate signal is retrieved from the feedback line. The digital comparator generates a digital delay value based on the digital activation value. The digital delay value indicates resistive-capacitive ("RC") delay of the one of the plurality of first gate lines connected to the feedback line.

10 Claims, 14 Drawing Sheets

(52) U.S. Cl.
CPC ..... *G09G 3/3696* (2013.01); *G09G 2310/027* (2013.01); *G09G 2310/0281* (2013.01); *G09G 2310/0283* (2013.01); *G09G 2310/0286* (2013.01); *G09G 2310/0289* (2013.01); *G09G 2310/0291* (2013.01); *G09G 2310/0297* (2013.01); *G09G 2310/08* (2013.01); *G09G 2320/0223* (2013.01); *G09G 2330/021* (2013.01)

(58) Field of Classification Search
CPC ... G09G 2310/0289; G09G 2310/0291; G09G 2310/0297; G09G 2310/08; G09G 2320/0223; G09G 2330/021; G09G 3/2092; G09G 3/3611; G09G 3/3677; G09G 3/3696
See application file for complete search history.

(56) References Cited

U.S. PATENT DOCUMENTS

| | | | | |
|---|---|---|---|---|
| 2013/0113722 | A1 | 5/2013 | Lee et al. | |
| 2016/0049127 | A1 | 2/2016 | Park | |
| 2016/0118006 | A1 | 4/2016 | Park et al. | |
| 2016/0180773 | A1 | 6/2016 | Lim | |
| 2016/0365051 | A1* | 12/2016 | Jung | G09G 3/3648 |
| 2016/0365066 | A1 | 12/2016 | Lim et al. | |
| 2016/0372025 | A1 | 12/2016 | Ahn et al. | |
| 2017/0162165 | A1* | 6/2017 | Xiong | G09G 3/3696 |

* cited by examiner

FIG. 10

| DIGITAL VALUE | VON | DIGITAL VALUE | VON | DIGITAL VALUE | VON | DIGITAL VALUE | VON |
|---|---|---|---|---|---|---|---|
| 0000 0000 | 28.0V | 0000 0101 | 29.0V | 0000 1010 | 30.0V | 0000 1111 | 31.0V |
| 0000 0001 | 28.2V | 0000 0110 | 29.2V | 0000 1011 | 30.2V | 0001 0000 | 31.2V |
| 0000 0010 | 28.4V | 0000 0111 | 29.4V | 0000 1100 | 30.4V | 0001 0001 | 31.4V |
| 0000 0011 | 28.6V | 0000 1000 | 29.6V | 0000 1101 | 30.6V | 0001 0010 | 31.6V |
| 0000 0100 | 28.8V | 0000 1001 | 29.8V | 0000 1110 | 30.8V | 0001 0011 | 31.8V |

FIG. 11A

| | |
|---|---|
| RVON = 0000 1010 | 30V |
| DVON1 = 0000 1000 | 29.6V |
| DVON2 = 0000 0110 | 29.2V |
| DVON3 = 0000 0100 | 28.8V |
| DVON4 = 0000 0010 | 28.4V |

FIG. 11B

| | |
|---|---|
| DHCV1 = 0000 1100 | 30.4V |
| DHCV2 = 0000 1110 | 30.8V |
| DHCV3 = 0001 0000 | 31.2V |
| DHCV4 = 0001 0010 | 31.6V |

DISPLAY APPARATUS

This application is a divisional of U.S. patent application Ser. No. 15/945,263, filed on Apr. 4, 2018, which claims priority to Korean Patent Application No. 10-2017-0053943, filed on Apr. 26, 2017, and all the benefits accruing therefrom under 35 U.S.C. § 119, the content of which in its entirety is herein incorporated by reference.

BACKGROUND

1. Field

Exemplary embodiments relate to a display apparatus including a display panel and a circuit for driving the display panel.

2. Description of the Related Art

A liquid crystal display apparatus is one of the most widely used types of flat panel display ("FPD"). The FPD may include, but are not limited to, a liquid crystal display ("LCD"), a plasma display panel ("PDP") and an organic light emitting display ("OLED"), for example.

A display apparatus typically includes a display panel in which a plurality of pixels is connected to respective gate lines and to respective data lines crossing the gate lines, which are on the display panel. The display apparatus may further include a gate driver configured for outputting gate signals to the gate lines.

SUMMARY

In a display apparatus, as the size of the display panel has increased, the gate line may become longer such that the gate signal may be distorted due to resistive-capacitive ("RC") delay of the gate line. In the display apparatus, as the size of the display panel has increased, lines for providing gate on/off voltages to the gate driver may become longer, such that a difference (e.g., a swing width) between a high level and a low level of the gate signal may be reduced. Accordingly, the disclosure is provided to substantially obviate one or more problems due to limitations and disadvantages of the related art.

An exemplary embodiment of the disclosure provides a display apparatus in which distortion of a gate signal is compensated.

An exemplary embodiment of the disclosure provides a display apparatus in which reduction of a swing width of a gate signal is compensated.

According to an exemplary embodiment, a display apparatus includes a display panel including a plurality of first gate lines, a first gate driver connected to first ends of the plurality of first gate lines, a second gate driver connected to second ends of the plurality of first gate lines, a feedback line connected adjacent to the first end of one of the plurality of first gate lines, and a gate delay sensing circuit connected to the feedback line. In such an embodiment, the gate delay sensing circuit includes a time-to-digital converter and a digital comparator. In such an embodiment, the time-to-digital converter converts an activation time of a feedback gate signal into a digital activation value, where the feedback gate signal is retrieved from the feedback line. In such an embodiment, the digital comparator generates a digital delay value based on the digital activation value, where the digital delay value indicates an RC delay of the one of the plurality of first gate lines connected to the feedback line.

In an exemplary embodiment, the time-to-digital converter may convert a first activation time of a first feedback gate signal into a first digital activation value by oversampling the first feedback gate signal, where the first feedback gate signal may be retrieved from the feedback line when the first gate driver is enabled and the second gate driver is disabled. In such an embodiment, the time-to-digital converter may convert a second activation time of a second feedback gate signal into a second digital activation value by oversampling the second feedback gate signal, where the second feedback gate signal may retrieved from the feedback line when the first gate driver is disabled and the second gate driver is enabled.

In an exemplary embodiment, the time-to-digital converter may detect the first activation time and may output a first bit periodically at a predetermined sampling cycle while a voltage level of the first feedback gate signal is higher than a reference voltage level. In such an embodiment, the time-to-digital converter may detect the second activation time and may output the first bit periodically at the sampling cycle while a voltage level of the second feedback gate signal is higher than the reference voltage level.

In an exemplary embodiment, the digital comparator may compare the first digital activation value with the second digital activation value to generate the digital delay value.

In an exemplary embodiment, each of the first digital activation value and the digital delay value may be represented as a combination of first bits, and the second digital activation value may be represented as a combination of the first bits and second bits. In such an embodiment, a number of the first bits included in the digital delay value may be substantially equal to a difference between a number of the first bits included in the first digital activation value and a number of the first bits included in the second digital activation value.

In an exemplary embodiment, the gate delay sensing circuit may further include a memory which stores the first digital activation value and the second digital activation value.

In an exemplary embodiment, the gate delay sensing circuit may be located inside the first gate driver.

In an exemplary embodiment, the display apparatus may further include a timing controller which compensates the RC delay based on the digital delay value.

In an exemplary embodiment, the one of the plurality of first gate lines connected to the feedback line may be a dummy gate line.

In an exemplary embodiment, the display panel may further include a plurality of pixels and a plurality of data lines. In such an embodiment, the plurality of pixels may be connected to the plurality of first gate lines, and the plurality of data lines may be connected to the plurality of pixels.

According to another exemplary embodiment, a display apparatus includes a display panel including a plurality of first gate lines and a plurality of second gate lines, a power supply circuit which generates a gate-on voltage, a first gate driver which drives the plurality of first gate lines based on the gate-on voltage and converts a first on level of the gate-on voltage at the first gate driver into a first digital high voltage value, a second gate driver which drives the plurality of second gate lines based on the gate-on voltage and converts a second on level of the gate-on voltage at the second gate driver into a second digital high voltage value, a first feedback line which provides the first digital high voltage value to the power supply circuit, and a second feedback line which provides the second digital high voltage value to the power supply circuit. In such an embodiment, the power supply circuit generates the gate-on voltage having a first high voltage level based on the first digital high voltage value during a first period during which the plurality of first gate lines are driven, and the power supply circuit generates the gate-on voltage having a second high voltage level based on the second digital high voltage value during a second period during which the plurality of second gate lines are driven, where the second high voltage level is different from the first high voltage level.

In an exemplary embodiment, the power supply circuit may include a digital comparator, a register encoder, a counter, a multiplexer and a voltage converter. In such an embodiment, the digital comparator may compare the first digital high voltage value with a digital high reference value to generate a first digital high difference value and may compare the second digital high voltage value with the digital high reference value to generate a second digital high difference value. In such an embodiment, the register encoder may generate a first digital high compensation value and a second digital high compensation value based on the first digital high difference value, the second digital high difference value and the digital high reference value. In such an embodiment, the counter may generate a first signal and a second signal based on a reference count value, where the first signal may be activated during the first period, and the second signal may be activated during the second period. In such an embodiment, the multiplexer may output one of the first digital high compensation value and the second digital high compensation value based on the first signal and the second signal. In such an embodiment, the voltage converter may generate the gate-on voltage based on an output of the multiplexer, where the gate-on voltage may have the first high voltage level during the first period and may have the second high voltage level during the second period.

In an exemplary embodiment, the register encoder may generate the first digital high compensation value and the second digital high compensation value based on a predetermined lookup table.

In an exemplary embodiment, the counter may count a gate clock signal based on a vertical start signal and the reference count value to activate the first signal during the first period and may count the gate clock signal based on the first signal and the reference count value to activate the second signal during the second period.

In an exemplary embodiment, the multiplexer may output the first digital high compensation value based on the first signal during the first period and may output the second digital high compensation value based on the second signal during the second period.

In an exemplary embodiment, the first gate driver may be located closer to the power supply circuit than the second gate driver, and the second high voltage level may be higher than the first high voltage level.

In an exemplary embodiment, the power supply circuit may further generate a gate-off voltage. In such an embodiment, the first gate driver may drive the plurality of first gate lines based on the gate-on voltage and the gate-off voltage and may further convert a first off level of the gate-off voltage at the first gate driver into a first digital low voltage value, and the second gate driver may drive the plurality of second gate lines based on the gate-on voltage and the gate-off voltage and may convert a second off level of the gate-off voltage at the second gate driver into a second digital low voltage value, where the first digital low voltage value and the second digital low voltage value may be provided to the power supply circuit. In such an embodiment, the power supply circuit may generate the gate-off voltage having a first low voltage level based on the first digital low voltage value during the first period, and the power supply circuit may generate the gate-off voltage having a second low voltage level based on the second digital low voltage value during the second period, where the second low voltage level may be different from the first low voltage level.

In an exemplary embodiment, the first gate driver may be located closer to the power supply circuit than the second gate driver, and the second low voltage level may be lower than the first low voltage level.

In an exemplary embodiment, each of the first gate driver and the second gate driver may include an analog-to-digital converter.

In an exemplary embodiment, the display panel may further include a plurality of pixels and a plurality of data lines. In such an embodiment, the plurality of pixels may be connected to the plurality of first gate lines and the plurality of second gate lines, and the plurality of data lines may be connected to the plurality of pixels.

In exemplary embodiments of the display apparatus and the display panel driving circuit thereof, the RC delay of the gate line may be efficiently sensed or detected by the gate delay sensing circuit, the amount of the RC delay may be provided as a digital value, and thus the distortion of the gate signal may be efficiently and objectively compensated. In such embodiments, the RC delay may be compensated based on a characteristic and/or a performance of the display apparatus, and thus the display apparatus may maintain characteristics thereof regardless of variations on manufacturing processes. In such embodiments, charging rate of the pixels may be improved.

In exemplary embodiments of the display apparatus and the display panel driving circuit thereof, the IR drop of the gate-on voltage and the gate-off voltage may be efficiently sensed or detected by the gate driving chips and the power supply circuit, the amount of the IR drop may be provided as a digital value, and thus the gate-on voltage and the gate-off voltage may be efficiently and objectively compensated. In such embodiments, the IR drop may be compensated to comply with a characteristic and/or a performance of the gate driving chip. In such embodiments, charging rate of the pixels may be improved.

BRIEF DESCRIPTION OF THE DRAWINGS

The above and other features of the invention will become more apparent by describing in further detail exemplary embodiments thereof with reference to the accompanying drawings, in which:

FIGS. 10, 11A, 11B and 12 are diagrams for describing an operation of the power supply circuit of FIG. 9.

DETAILED DESCRIPTION OF THE EMBODIMENTS

Figure 1:
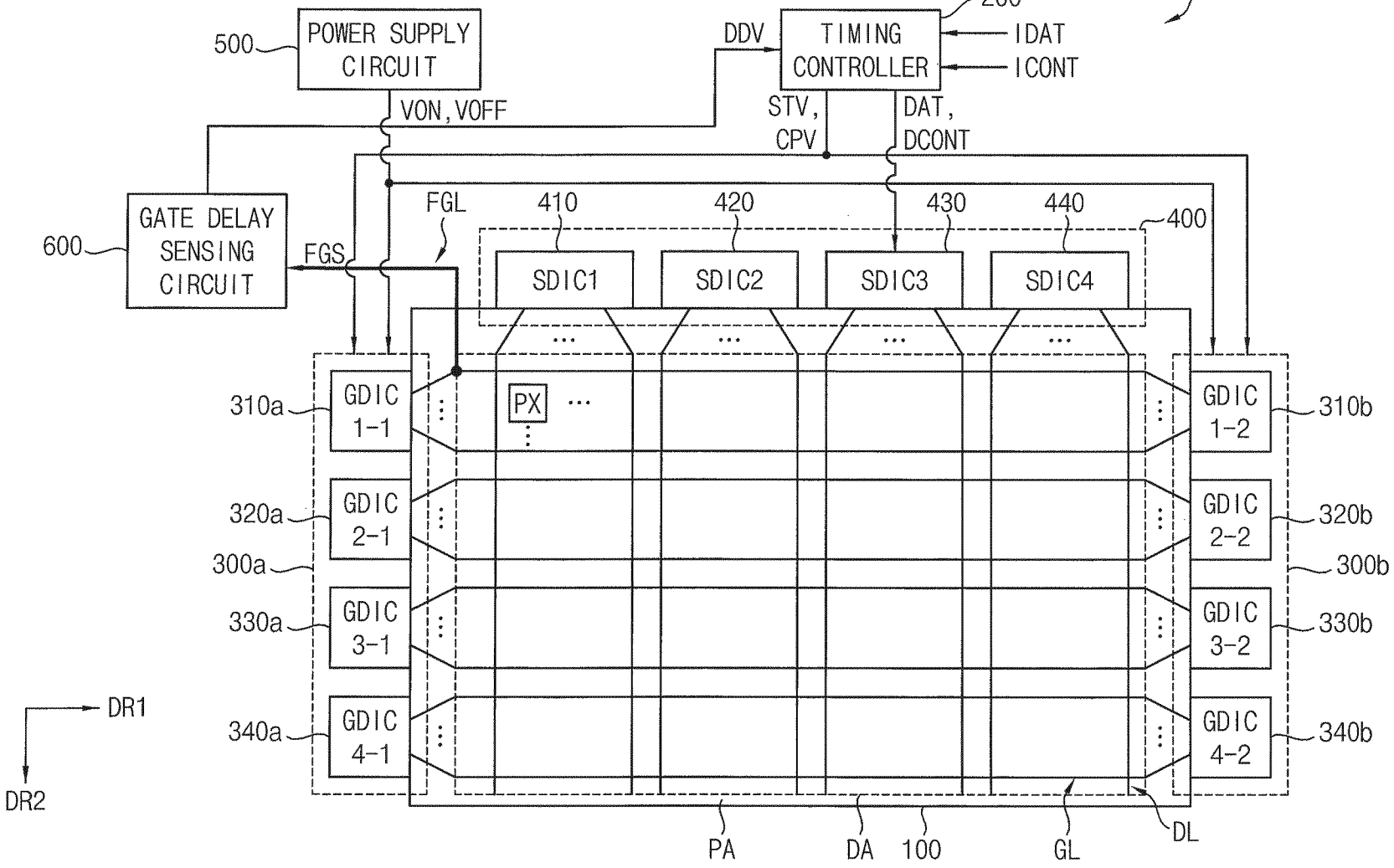
FIG. 1 is a block diagram illustrating a display apparatus according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, exemplary embodiments of the invention will be described in detail with reference to the accompanying drawings.

FIG. 1 is a block diagram illustrating a display apparatus according to an exemplary embodiment.

Referring to FIG. 1, an exemplary embodiment of a display apparatus 10 includes a display panel 100 and a display panel driving circuit.

The display panel 100 operates (e.g., display an image) based on output image data DAT. The display panel 100 includes a plurality of pixels PX, a plurality of gate lines GL and a plurality of data lines DL. The gate lines GL may extend in a first direction DR1, and the data lines DL may extend in a second direction DR2 crossing (e.g., substantially perpendicular to) the first direction DR1. Each of the pixels PX may be electrically connected to a respective one of the gate lines GL and a respective one of the data lines DL. The display panel 100 may include a display region DA and a peripheral region PA. The plurality of pixels PX may be disposed or arranged in the display region DA, and the peripheral region PA may surround the display region DA.

The display panel 100 is driven by a control of the display panel driving circuit. The display panel driving circuit includes gate driving circuits 300*a* and 300*b*, a feedback line FGL and a gate delay sensing circuit 600. The display panel driving circuit may further include a timing controller 200, a data driving circuit 400 and a power supply circuit 500.

The timing controller 200 controls overall operations of the display apparatus 10. The timing controller 200 receives input image data IDAT and an input control signal ICONT from an external device (e.g., a host or a graphic processor). The input image data IDAT may include a plurality of pixel data for the plurality of pixels PX. The input control signal ICONT may include a master clock signal, a data enable signal, a vertical synchronization signal and a horizontal synchronization signal, for example.

The timing controller 200 generates the output image data DAT based on the input image data IDAT. The timing controller 200 generates a vertical start signal STV, a gate clock signal CPV and a data control signal DCONT based on the input control signal ICONT. In one exemplary embodiment, for example, the data control signal DCONT may include a horizontal start signal, a data clock signal, a polarity control signal, a data load signal, etc.

The power supply circuit 500 generates a gate-on voltage VON and a gate-off voltage VOFF. In one exemplary embodiment, for example, the power supply circuit 500 may include a voltage converter, e.g., a direct-current-to-direct-current ("DC-DC") converter.

The gate driving circuits 300*a* and 300*b* are connected to the display panel 100 through the gate lines GL. The gate driving circuits 300*a* and 300*b* generate a plurality of gate signals for driving the display panel 100 based on the vertical start signal STV, the gate clock signal CPV, the gate-on voltage VON and the gate-off voltage VOFF. In one exemplary embodiment, for example, the gate driving circuits 300*a* and 300*b* may sequentially provide or apply the gate signals to the display panel 100 through the gate lines GL.

The gate driving circuits 300*a* and 300*b* may include a first gate driving circuit 300*a* and a second gate driving circuit 300*b*. The first gate driving circuit 300*a* is connected to first ends (e.g., left ends) of the gate lines GL, and the second gate driving circuit 300*b* is connected to second ends (e.g., right ends) of the gate lines GL. In one exemplary embodiment, for example, the first gate driving circuit 300*a* may be disposed at a first side (e.g., a left side) of the display panel 100, and the second gate driving circuit 300*b* may be disposed at a second side (e.g., a right side) of the display panel 100 that is opposite to the first side of the display panel 100. The first gate driving circuit 300*a* may include a plurality of gate driving chips 310*a*, 320*a*, 330*a* and 340*a* (referred to as GDIC1-1, GDIC2-1, GDIC3-1 and GDIC4-1 in FIG. 1). The second gate driving circuit 300*b* may include a plurality of gate driving chips 310*b*, 320*b*, 330*b* and 340*b* (referred to as GDIC1-2, GDIC2-2, GDIC3-2 and GDIC4-2 in FIG. 1). In one exemplary embodiment, for example, each gate driving chip may include a shift register, a level shifter and an output buffer. In an exemplary embodiment, as shown in FIG. 1, each gate driving chip 300*a* or 300*b* may a single gate driver.

In an exemplary embodiment of the display apparatus 10, a pair of gate driving chips may be connected to both ends of a same gate line, respectively. In one exemplary embodiment, for example, the gate driving chips 310*a* and 310*b* may be connected to both ends of first gate lines that are disposed in a first region of the display panel 100, and the first gate lines may be driven by the gate driving chips 310*a* and 310*b*. In such an embodiment, the gate driving chip 310*a* may be connected to first ends of the first gate lines, and the gate driving chip 310*b* may be connected to second ends of the first gate lines. In such an embodiment, the gate driving chips 320*a* and 320*b* may be connected to both ends of second gate lines that are disposed in a second region of the display panel 100, the gate driving chips 330*a* and 330*b* may be connected to both ends of third gate lines that are disposed in a third region of the display panel 100, and the gate driving chips 340*a* and 340*b* may be connected to both ends of fourth gate lines that are disposed in a fourth region of the display panel 100.

In an exemplary embodiment, the feedback line FGL is connected adjacent to a first end of one of the gate lines GL. In one exemplary embodiment, for example, as illustrated in FIG. 1, the feedback line FGL may be connected adjacent to a first end of one (e.g., an uppermost gate line) of the first gate lines that are connected to the gate driving chips 310*a* and 310*b*. A gate signal that is generated by the gate driving chips 310*a* and 310*b* may be retrieved from one gate line (e.g., from the gate line connected to the feedback line FGL) through the feedback line FGL.

The gate delay sensing circuit 600 is connected to the feedback line FGL, and receives a feedback gate signal FGS from the feedback line FGL. The gate delay sensing circuit 600 converts an activation time of the feedback gate signal FGS into a digital value, and generates a digital delay value DDV based on the digital value. The digital delay value DDV indicates resistive-capacitive ("RC") delay of the one gate line (e.g., the gate line connected to the feedback line FGL). The digital delay value DDV may be provided to the timing controller 200, and the RC delay may be compensated based on the digital delay value DDV. A configuration and an operation of the gate delay sensing circuit 600 will be described later in greater detail with reference to FIGS. 2, 3A, 3B, 4A and 4B.

The data driving circuit 400 is connected to the display panel 100 through the data lines DL. The data driving circuit 400 generates a plurality of data voltages (e.g., analog voltages) for driving the display panel 100 based on the output image data DAT (e.g., digital data) and the data control signal DCONT. In one exemplary embodiment, for example, the data driving circuit 400 may sequentially provide or apply the data voltages to a plurality of lines (e.g., horizontal lines) in the display panel 100 through the data lines DL. The data driving circuit 400 may include a plurality of data driving chips 410, 420, 430 and 440 (also referred to as SDIC1, SDIC2, SDIC3 and SDIC4 in FIG. 1). In one exemplary embodiment, for example, each data driving chip may include a shift register, a data latch, a digital-to-analog converter and an output buffer.

Figure 2:
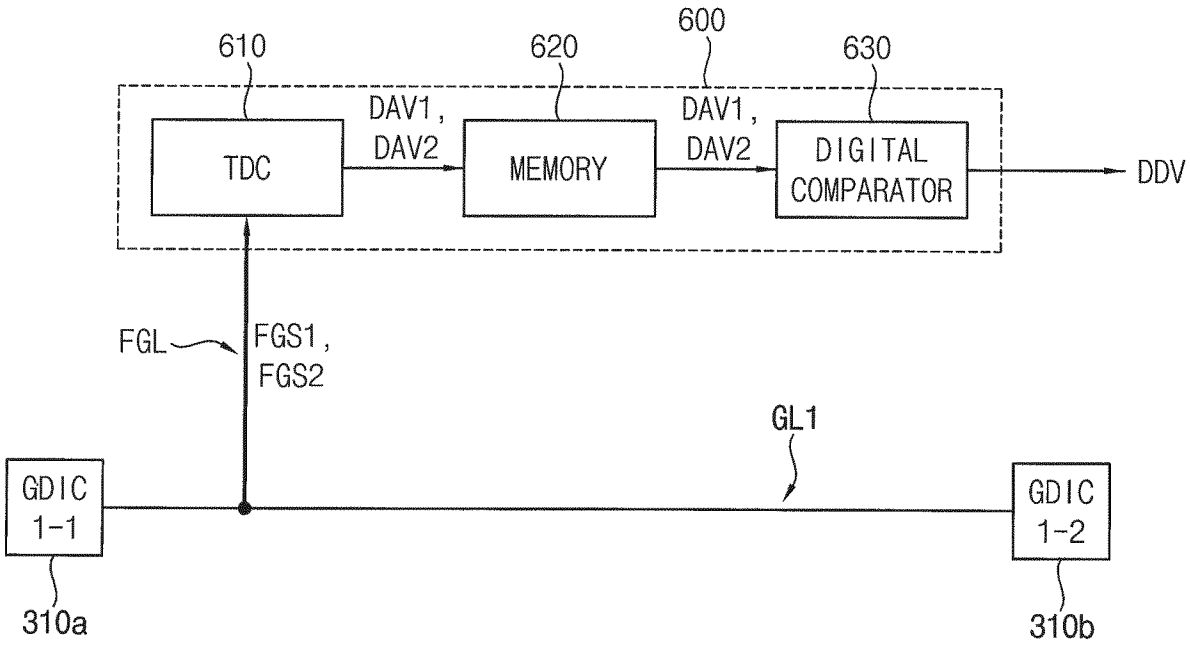
FIG. 2 is a block diagram illustrating a display panel driving circuit included in the display apparatus of FIG. 1.

FIG. 2 is a block diagram illustrating a display panel driving circuit included in the display apparatus of FIG. 1.

Referring to FIGS. 1 and 2, the display panel driving circuit includes the gate driving chips 310*a* and 310*b*, the feedback line FGL and the gate delay sensing circuit 600. For convenience of illustration, FIG. 2 illustrates only one gate line (e.g., a gate line GL1) that is connected to the feedback line FGL and is one of the first gate lines connected to the gate driving chips 310*a* and 310*b*.

The gate driving chips 310*a* and 310*b* are connected to the first and second ends of the gate line GL1, respectively. The feedback line FGL is connected adjacent to the first end of the gate line GL1. The gate delay sensing circuit 600 is connected to the feedback line FGL.

In an exemplary embodiment, the gate delay sensing circuit 600 includes a time-to-digital converter ("TDC") 610 and a digital comparator 630. The gate delay sensing circuit 600 may further include a memory 620.

In such an embodiment, the time-to-digital converter 610 converts an activation time of a feedback gate signal retrieved from the feedback line FGL into a digital activation value. In one exemplary embodiment, for example, two feedback gate signals FGS1 and FGS2 may be independently and separately received from the feedback line FGL. The time-to-digital converter 610 may convert an activation time of a first feedback gate signal FGS1 (also referred to as a first activation time) into a first digital activation value DAV1, and may convert an activation time of a second feedback gate signal FGS2 (also referred to as a second activation time) into a second digital activation value DAV2. An operation of the time-to-digital converter 610 will be described later in greater detail with reference to FIGS. 4A and 4B.

In such an embodiment, the digital comparator 630 generates the digital delay value DDV based on the digital activation value. The digital delay value DDV indicates RC delay of the gate line GL1 connected to the feedback line FGL. In one exemplary embodiment, for example, the digital comparator 630 may compare the first digital activation value DAV1 with the second digital activation value DAV2 to generate the digital delay value DDV.

The memory 620 may store and output the first digital activation value DAV1 and the second digital activation value DAV2. In one exemplary embodiment, for example, the memory 620 may include a volatile memory, such as a register, a dynamic random access memory ("DRAM"), etc., and/or a nonvolatile memory, such as a flash memory, etc.

Figure 3A:
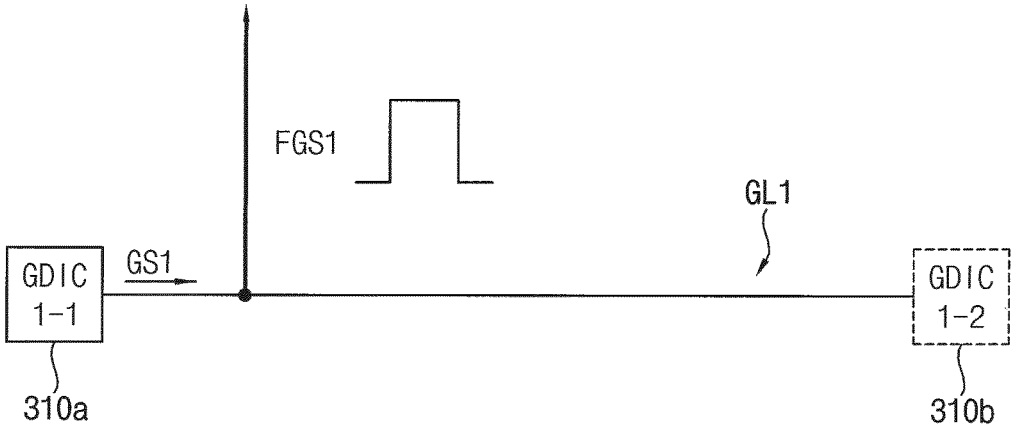
FIGS. 3A, 3B, 4A and 4B are diagrams for describing an operation of the display panel driving circuit of FIG. 2.
Figure 3B:
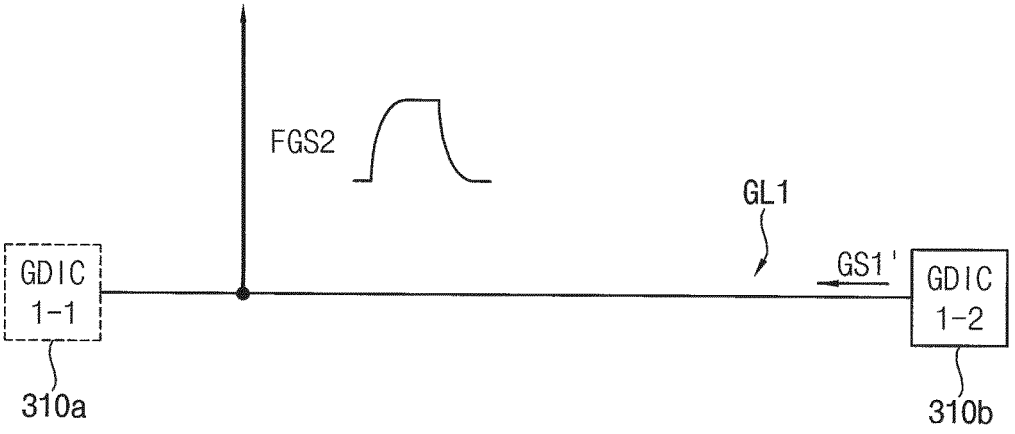
Figure 4A:
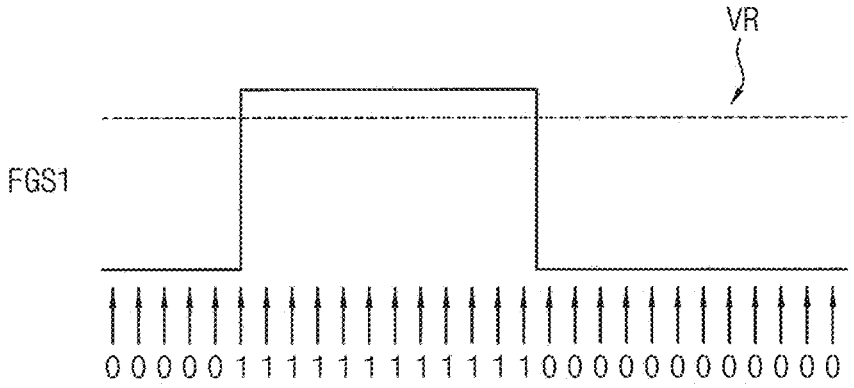
Figure 4B:
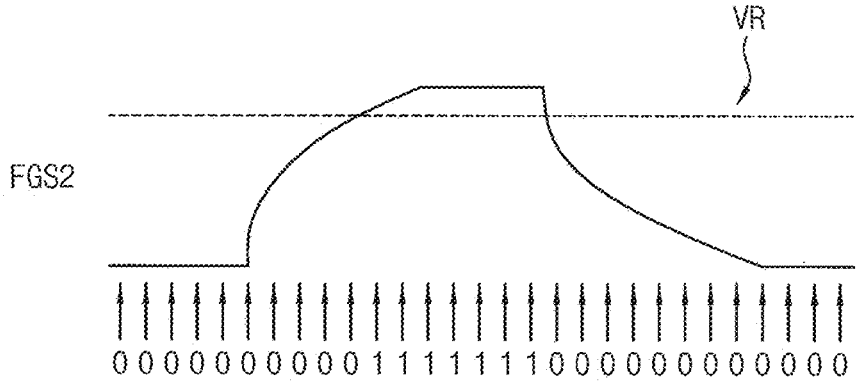

FIGS. 3A, 3B, 4A and 4B are diagrams for describing an operation of the display panel driving circuit of FIG. 2. FIGS. 3A and 3B illustrate an operation of retrieving a gate signal from the gate line GL1 through the feedback line FGL. FIGS. 4A and 4B illustrate an operation of the time-to-digital converter 610.

Referring to FIG. 3A, the gate driving chip 310*a* may be enabled, and the gate driving chip 310*b* may be disabled. The disabled gate driving chip 310*b* is illustrated with the dotted line in FIG. 3A. Subsequently, a gate signal GS1 may be provided to the gate line GL1 by only the enabled gate driving chip 310*a*, and the first feedback gate signal FGS1 may be obtained by retrieving the gate signal GS1 generated from the enabled gate driving chip 310*a*. As shown in FIG. 3A, since the retrieved gate signal GS1 scarcely passes through the gate line GL1, a waveform of the first feedback gate signal FGS1 may be almost the same as a waveform of the gate signal GS1.

Referring to FIG. 3B, the gate driving chip 310*a* may be disabled, and the gate driving chip 310*b* may be enabled. The disabled gate driving chip 310*a* is illustrated with the dotted line in FIG. 3B. Subsequently, a gate signal GS1' may be provided to the gate line GL1 by only the enabled gate driving chip 310*b*, and the second feedback gate signal FGS2 may be obtained by retrieving the gate signal GS1' generated from the enabled gate driving chip 310*b*. A waveform of the gate signal GS1' in FIG. 3B, which is generated from the enabled gate driving chip 310*b*, may be substantially the same as the waveform of the gate signal GS1 in FIG. 3A. However, as shown in FIG. 3B, since the retrieved gate signal GS1' passes substantially through an entire portion of the gate line GL1, a waveform of the second feedback gate signal FGS2 may be different from the waveform of the gate signal GS1' and may be distorted due to the RC delay of the gate line GL1.

Although not illustrated in FIGS. 3A and 3B, both the gate driving chips 310*a* and 310*b* may be enabled while the display apparatus operates in a normal mode. In the normal mode, the gate signals GS1 and GS 1' that are substantially the same as each other may be substantially simultaneously or concurrently provided to the gate line GL1 by both of the gate driving chips 310*a* and 310*b*.

Referring to FIGS. 2 and 4A, the time-to-digital converter 610 may convert the activation time of the first feedback gate signal FGS1 (i.e., the first activation time) into the first digital activation value DAV1 by oversampling the first feedback gate signal FGS1. As used herein, the term "oversampling" indicates a sampling operation with a sampling cycle that is very small (e.g., smaller than a target or an activation time of the gate signal).

In one exemplary embodiment, for example, while a voltage level of the first feedback gate signal FGS1 is higher than a reference voltage level VR, the time-to-digital converter 610 may detect the first activation time (e.g., may determine that a time corresponds to the first activation time) and may output a first bit (e.g., "1") periodically at a predetermined sampling cycle. While the voltage level of the first feedback gate signal FGS1 is lower than the reference voltage level VR, the time-to-digital converter 610 may determine that a present time does not correspond to the first activation time and may output a second bit (e.g., "0") periodically at the sampling cycle.

In some exemplary embodiments, the first digital activation value DAV1 may be represented as a combination of only the first bits. In one exemplary embodiment, for example, after the first feedback gate signal FGS1 is input to the time-to-digital converter 610, the number of the first bits that are continuously output from the time-to-digital converter 610 may correspond to the first activation time, that is the activation time of the first feedback gate signal FGS1. Thus, all of the first bits that are continuously output from the time-to-digital converter 610 may be set to the first digital activation value DAV1. In an exemplary embodiment, as shown in FIG. 4A, the first digital activation value DAV1 may be "111111111111."

Referring to FIGS. 2 and 4B, the time-to-digital converter 610 may convert the activation time of the second feedback gate signal FGS2 (i.e., the second activation time) into the second digital activation value DAV2 by oversampling the second feedback gate signal FGS2.

In one exemplary embodiment, for example, while a voltage level of the second feedback gate signal FGS2 is higher than the reference voltage level VR, the time-to-digital converter 610 may detect the second activation time (e.g., may determine that a time corresponds to the second activation time) and may output the first bit (e.g., "1") periodically at the sampling cycle. While the voltage level of the second feedback gate signal FGS2 is lower than the reference voltage level VR, the time-to-digital converter 610 may determine that a present time does not correspond to the second activation time and may output the second bit (e.g., "0") periodically at the sampling cycle.

In some exemplary embodiments, a length of the second digital activation value DAV2 may be substantially equal to as a length of the first digital activation value DAV1, and thus the second digital activation value DAV2 may be represented as a combination of both the first bits and the second bits. In one exemplary embodiment, for example, after the second feedback gate signal FGS2 is input to the time-to-digital converter 610, the number of the first bits that are continuously output from the time-to-digital converter 610 may correspond to the second activation time of the second feedback gate signal FGS2. In such an embodiment, it is desired to match the length of the first digital activation value DAV1 with the length of the second digital activation value DAV2 (e.g., with the same length) to easily compare the first digital activation value DAV1 with the second digital activation value DAV2. Thus, all of the first bits that are continuously output from the time-to-digital converter 610 and some of the second bits that are output from the time-to-digital converter 610 after the first bits may be set to the second digital activation value DAV2. In an exemplary embodiment, as shown in FIG. 4B, the second digital activation value DAV2 may be "111111100000."

The digital comparator 630 may compare the first digital activation value DAV1 with the second digital activation value DAV2 to generate the digital delay value DDV. In one exemplary embodiment, for example, as illustrated in FIGS. 4A and 4B, when the first digital activation value DAV1 is "111111111111" and the second digital activation value DAV2 is "111111100000," the digital comparator 630 may output "11111," which is a difference between the first digital activation value DAV1 and the second digital activation value DAV2, as the digital delay value DDV. In such an embodiment, the digital delay value DDV may be represented as a combination of only the first bits. The number of the first bits included in the digital delay value DDV may be substantially equal to a difference between the number of the first bits included in the first digital activation value DAV1 and the number of the first bits included in the second digital activation value DAV2.

Referring back to FIG. 1, the timing controller 200 may compensate the RC delay based on the digital delay value DDV.

In some exemplary embodiments, the timing controller 200 may compensate the RC delay by controlling (e.g., changing or modifying) the gate clock signal CPV based on the digital delay value DDV. In one exemplary embodiment, for example, a pulse width and/or a waveform of the gate clock signal CPV may be adjusted, and thus a pulse in the gate signal may be shifted because the gate signal is generated based on the gate clock signal CPV. Such compensation may be referred to as a gate shift scheme.

In other exemplary embodiments, the timing controller 200 may compensate the RC delay by controlling (e.g., changing or modifying) an output timing of the data signals based on the digital delay value DDV. In one exemplary embodiment, for example, an output timing of a data signal applied to an edge of the display panel 100 and/or an output timing of a data signal applied to a center of the display panel 100 may be differently adjusted (e.g., with a data output delay), and thus a pulse in the data signal may be shifted such that the pulse in the data signal is matched with the pulse in the gate signal. Such compensation may be referred to as a TCON shift scheme or a DMS shift scheme.

Figure 5A:
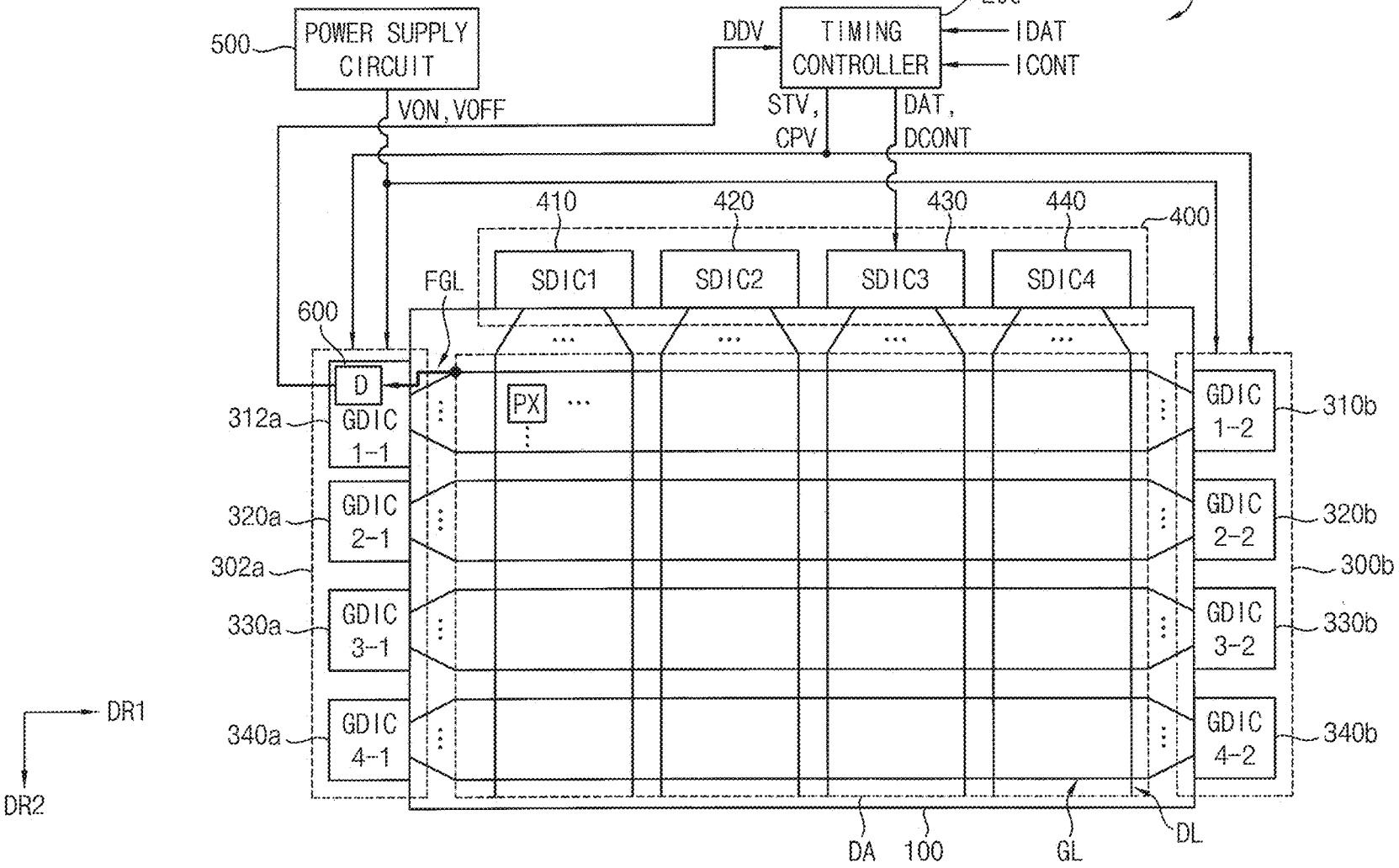
FIGS. 5A and 5B are block diagrams illustrating a display apparatus according to alternative exemplary embodiments.
Figure 5B:
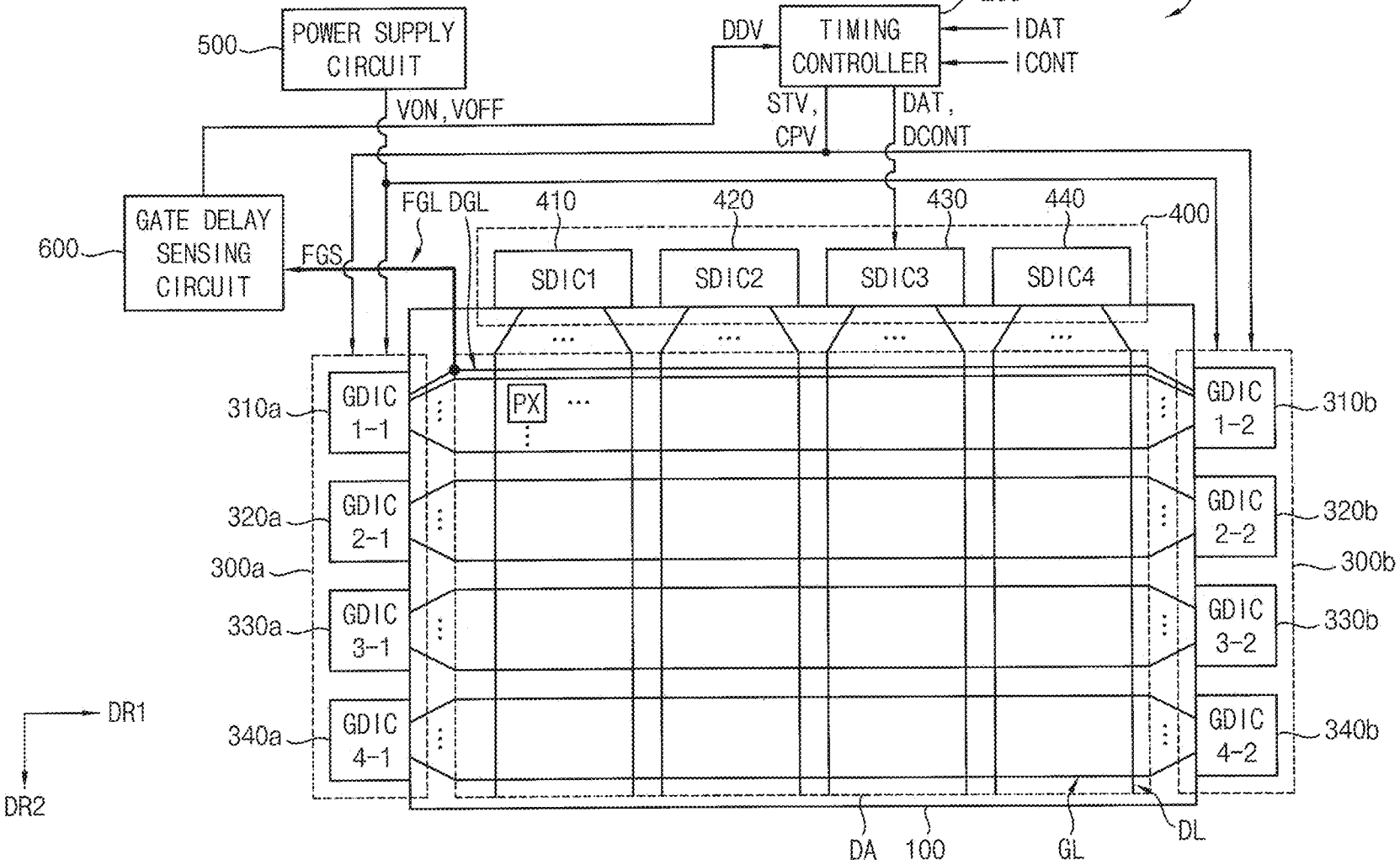

FIGS. 5A and 5B are block diagrams illustrating a display apparatus according to alternative exemplary embodiments.

Referring to FIG. 5A, an alternative exemplary embodiment of a display apparatus 10*a* includes a display panel 100 and a display panel driving circuit. The display panel driving circuit includes gate driving circuits 302*a* and 300*b*, a feedback line FGL and a gate delay sensing circuit 600. The display panel driving circuit may further include a timing controller 200, a data driving circuit 400 and a power supply circuit 500.

The display apparatus 10*a* of FIG. 5A may be substantially the same as the display apparatus 10 of FIG. 1, except that the gate delay sensing circuit 600 is located inside a gate driving chip 312*a*.

Referring to FIG. 5B, another alternative exemplary embodiment of a display apparatus 10*b* includes a display panel 100 and a display panel driving circuit. The display panel driving circuit includes gate driving circuits 300*a* and 300*b*, a feedback line FGL and a gate delay sensing circuit 600. The display panel driving circuit may further include a timing controller 200, a data driving circuit 400 and a power supply circuit 500.

The display apparatus 10*b* of FIG. 5B may be substantially the same as the display apparatus 10 of FIG. 1, except that the feedback line FGL is connected to a dummy gate line DGL.

In such an embodiment, the dummy gate line DGL may be connected to dummy pixels or a dummy pixel row. The dummy pixels may be different from the plurality of pixels PX. The dummy gate line DGL, the dummy pixels and the dummy pixel row may not be directly associated with an image display operation of the display panel 100.

In the exemplary embodiments of the display apparatus and the display panel driving circuit described above with reference to FIGS. 1 through 5B, the RC delay of the gate line may be efficiently sensed or detected by the gate delay sensing circuit 600, the amount of the RC delay may be provided as a digital value, and thus the distortion of the gate signal may be efficiently and objectively compensated. In such embodiments, the RC delay may be compensated to comply with a characteristic and/or a performance of the display apparatus, and thus the display apparatus may have the substantially same characteristic regardless of variations on manufacturing processes. Further, in such embodiments, charging rate of the pixels PX may be improved.

According to exemplary embodiments, an operation of sensing and compensating the RC delay described with reference to FIGS. 1 through 5B may be performed once during a manufacturing process of the display apparatus, or may be repeatedly performed when the display apparatus is initialized. In one exemplary embodiment, for example, the digital delay value DDV may be set during a manufacturing process of the display apparatus and may be fixed. In one alternative exemplary embodiment, for example, the digital delay value DDV may be set whenever power is supplied to the display apparatus or whenever the display apparatus is turned on.

In exemplary embodiments, as described above, the feedback line FGL is connected adjacent to the first end (e.g., the left end) of the gate line, but not being limited thereto. In alternative exemplary embodiments, the feedback line may be connected adjacent to the second end (e.g., the right end) of the gate line, or the feedback line may be connected adjacent to both the first and second ends of the gate line.

In exemplary embodiments, as described above, the display apparatus may include a single feedback line FGL, but not being limited thereto. In alternative exemplary embodiments, the display apparatus may include two or more feedback lines connected to different gate lines. In one exemplary embodiment, for example, two feedback lines may be connected to two different gate lines among the first gate lines, respectively. I one alternative exemplary embodiment, for example, four feedback lines may be connected to one of the first gate lines, one of the second gate lines, one of the third gate lines and one of the fourth gate lines, respectively.

Figure 6:
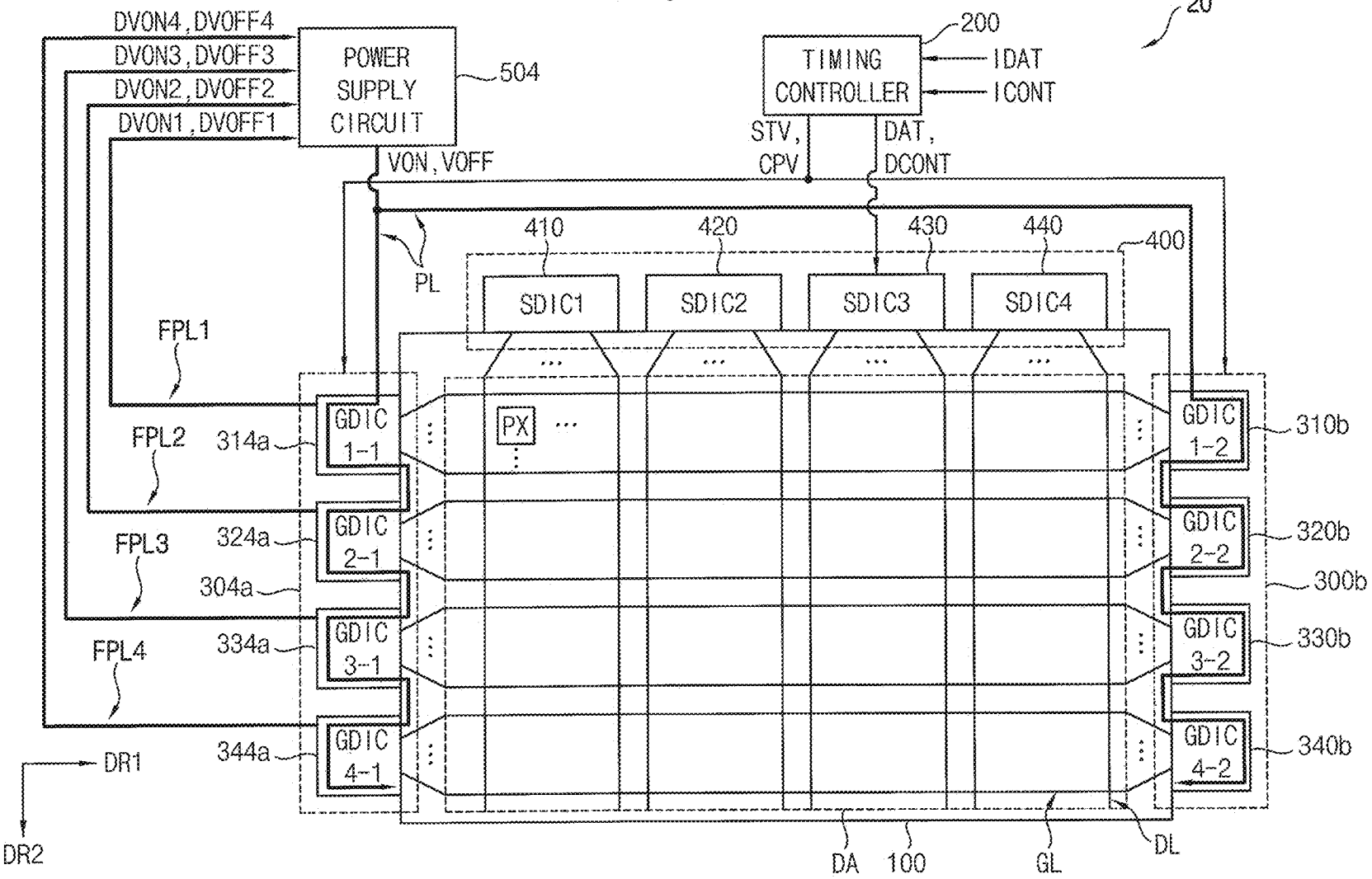
FIG. 6 is a block diagram illustrating a display apparatus according to another alternative exemplary embodiment.

FIG. 6 is a block diagram illustrating a display apparatus according to an alternative exemplary embodiment.

Referring to FIG. 6, an exemplary embodiment of a display apparatus 20 includes a display panel 100 and a display panel driving circuit. The display panel 100 is driven by a control of the display panel driving circuit. The display panel driving circuit includes a power supply circuit 504, a first gate driving circuit 304*a* and feedback lines FPL1, FPL2, FPL3 and FPL4. The display panel driving circuit may further include a timing controller 200, a second gate driving circuit 300*b* and a data driving circuit 400.

The display panel 100, the timing controller 200, the second gate driving circuit 300*b* and the data driving circuit 400 in FIG. 6 may be substantially the same as the display panel 100, the timing controller 200, the second gate driving circuit 300*b* and the data driving circuit 400 in FIG. 1, respectively, and any repetitive detailed descriptions thereof may be omitted or simplified.

In such an embodiment, the power supply circuit 504 generates a gate-on voltage VON and a gate-off voltage VOFF. The power supply circuit 504 may change or adjust a level of the gate-on voltage VON and a level of the gate-off voltage VOFF based on a first digital high voltage value DVON1, a second digital high voltage value DVON2, a third digital high voltage value DVON3, a fourth digital high voltage value DVON4, a first digital low voltage value DVOFF1, a second digital low voltage value DVOFF2, a third digital low voltage value DVOFF3 and a fourth digital low voltage value DVOFF4. In one exemplary embodiment, for example, the level of the gate-on voltage VON and the level of the gate-off voltage VOFF may be changed by lapse of time. A configuration and an operation of the power supply circuit 504 will be described later in greater detail with reference to FIGS. 7, 9, 10, 11A, 11B and 12.

In such an embodiment, the gate-on voltage VON and the gate-off voltage VOFF may be provided to the gate driving circuits 304*a* and 300*b* through a power line PL. Although not illustrated in FIGS. 1, 5A and 5B, each of the display apparatus 10 of FIG. 1, the display apparatus 10*a* of FIG. 5A and the display apparatus 10*b* of FIG. 5B may also include a power line that is substantially the same as the power line PL in FIG. 6.

In an exemplary embodiment, the first gate driving circuit 304*a* may include a plurality of gate driving chips 314*a*, 324*a*, 334*a* and 344*a* (also referred to as GDIC1-1, GDIC2-1, GDIC3-1 and GDIC4-1 in FIG. 6). The gate driving chip 314*a* is connected to first ends of first gate lines that are disposed in a first region of the display panel 100, drives the first gate lines based on the vertical start signal STV, the gate clock signal CPV, the gate-on voltage VON and the gate-off voltage VOFF, converts a first on level of the gate-on voltage VON at the gate driving chip 314*a* into the first digital high voltage value DVON1, and converts a first off level of the gate-off voltage VOFF at the gate driving chip 314*a* into the first digital low voltage value DVOFF1.

In such an embodiment, the gate driving chip 324*a* is connected to first ends of second gate lines that are disposed in a second region of the display panel 100, drives the second gate lines based on the vertical start signal STV, the gate clock signal CPV, the gate-on voltage VON and the gate-off voltage VOFF, and converts a second on level of the gate-on voltage VON and a second off level of the gate-off voltage VOFF at the gate driving chip 324*a* into the second digital high voltage value DVON2 and the second digital low voltage value DVOFF2, respectively.

The gate driving chip 334*a* is connected to first ends of third gate lines that are disposed in a third region of the display panel 100, drives the third gate lines based on the vertical start signal STV, the gate clock signal CPV, the gate-on voltage VON and the gate-off voltage VOFF, and converts a third on level of the gate-on voltage VON and a third off level of the gate-off voltage VOFF at the gate driving chip 334*a* into the third digital high voltage value DVON3 and the third digital low voltage value DVOFF3, respectively.

The gate driving chip 344*a* is connected to first ends of fourth gate lines that are disposed in a fourth region of the display panel 100, drives the fourth gate lines based on the vertical start signal STV, the gate clock signal CPV, the gate-on voltage VON and the gate-off voltage VOFF, and converts a fourth on level of the gate-on voltage VON and a fourth off level of the gate-off voltage VOFF at the gate driving chip 344*a* into the fourth digital high voltage value DVON4 and the fourth digital low voltage value DVOFF4, respectively. In an exemplary embodiment, as shown in FIG. 6, each gate driving chip may define a single gate driver.

In such an embodiment, the first feedback line FPL1 provides the first digital high voltage value DVON1 and the first digital low voltage value DVOFF1 to the power supply circuit 504. The second feedback line FPL2 provides the second digital high voltage value DVON2 and the second digital low voltage value DVOFF2 to the power supply circuit 504. The third feedback line FPL3 provides the third digital high voltage value DVON3 and the third digital low voltage value DVOFF3 to the power supply circuit 504. The fourth feedback line FPL4 provides the fourth digital high voltage value DVON4 and the fourth digital low voltage value DVOFF4 to the power supply circuit 504.

In some exemplary embodiments, to assure accuracy of measurement, resistances of the feedback lines FPL1, FPL2, FPL3 and FPL4 may be substantially equal to each other. In one exemplary embodiment, for example, where lengths of the feedback lines FPL1, FPL2, FPL3 and FPL4 are different from each other, thicknesses and/or widths of the feedback lines FPL1, FPL2, FPL3 and FPL4 may be different from each other to set the resistances of the feedback lines FPL1, FPL2, FPL3 and FPL4 to a same resistance. In one exemplary embodiment, for example, the first feedback line FPL1 has the shortest length, and the fourth feedback line FPL4 has the longest length such that the first feedback line FPL1 may have the smallest thickness and/or the smallest width, and the fourth feedback line FPL4 may have the largest thickness and/or the largest width.

FIG. 6 illustrates an exemplary embodiment where each of the power line PL and the feedback lines FPL1, FPL2, FPL3 and FPL4 includes a single wiring, but not being limited thereto. Alternatively, each of the power line PL and the feedback lines FPL1, FPL2, FPL3 and FPL4 may include a pair of wirings for transmitting the gate-on voltage VON and the gate-off voltage VOFF.

Figure 7:
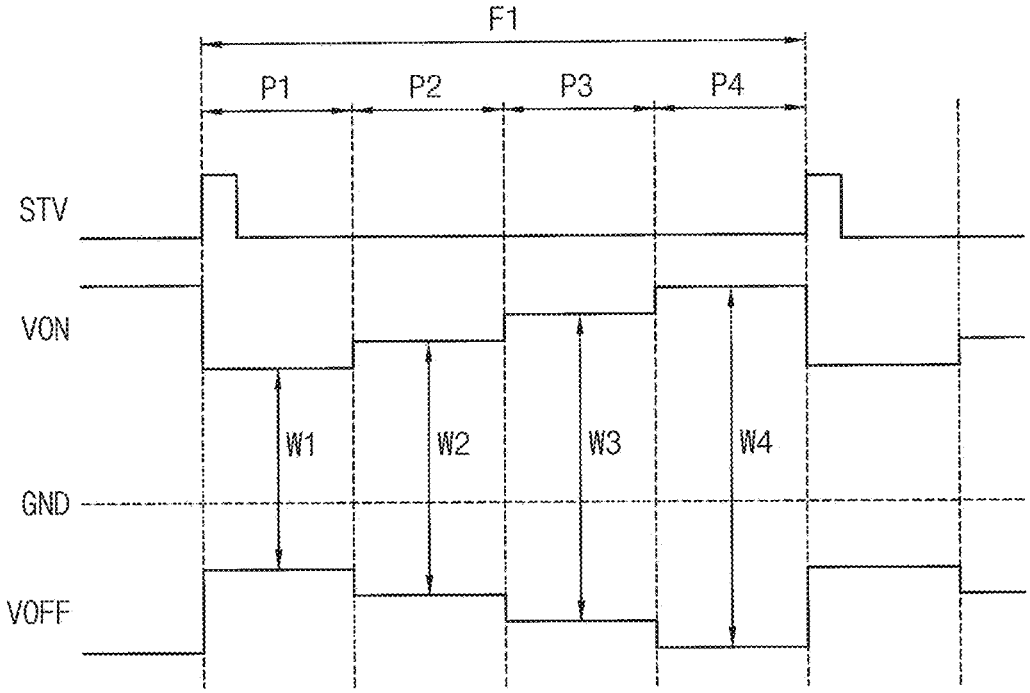
FIG. 7 is a diagram for describing an operation of a display panel driving circuit included in the display apparatus of FIG. 6.

FIG. 7 is a diagram for describing an operation of a display panel driving circuit included in the display apparatus of FIG. 6.

Referring to FIGS. 6 and 7, the gate lines GL may be sequentially driven from an uppermost gate line to a lowermost gate line. In one exemplary embodiment, for example, the first gate lines connected to the gate driving chip 314*a* may be driven during a first period P1, the second gate lines connected to the gate driving chip 324*a* may be driven during a second period P2, the third gate lines connected to the gate driving chip 334*a* may be driven during a third period P3, and the fourth gate lines connected to the gate driving chip 344*a* may be driven during a fourth period P4. The first period P1, the second period P2, the third period P3 and the fourth period P4 may be included in a single frame period F1 that is defined based on the vertical start signal STV and indicates a time interval for displaying a single frame image.

During the first period P1, the power supply circuit 504 may generate the gate-on voltage VON having a first high voltage level and the gate-off voltage VOFF having a first low voltage level based on the first digital high voltage value DVON1 and the first digital low voltage value DVOFF1. During the second period P2, the power supply circuit 504 may generate the gate-on voltage VON having a second high voltage level and the gate-off voltage VOFF having a second low voltage level based on the second digital high voltage value DVON2 and the second digital low voltage value DVOFF2. During the third period P3, the power supply circuit 504 may generate the gate-on voltage VON having a third high voltage level and the gate-off voltage VOFF having a third low voltage level based on the third digital high voltage value DVON3 and the third digital low voltage value DVOFF3. During the fourth period P4, the power supply circuit 504 may generate the gate-on voltage VON having a fourth high voltage level and the gate-off voltage VOFF having a fourth low voltage level based on the fourth digital high voltage value DVON4 and the fourth digital low voltage value DVOFF4.

In some exemplary embodiments, the level of the gate-on voltage VON may be higher than a ground voltage GND, e.g., about zero (0) volt (V), and the level of the gate-off voltage VOFF may be lower than the ground voltage GND.

In some exemplary embodiments, the gate driving chip 314*a* may be located closer to the power supply circuit 504 than the gate driving chip 324*a*, the gate driving chip 324*a* may be located closer to the power supply circuit 504 than the gate driving chip 334*a*, and the gate driving chip 334*a* may be located closer to the power supply circuit 504 than the gate driving chip 344*a*. In such embodiments, the power line between the gate driving chip 314*a* and the power supply circuit 504 may have the shortest length, and the power line between the gate driving chip 344*a* and the power supply circuit 504 may have the longest length. In such an embodiment, the second high voltage level may be higher than the first high voltage level, the third high voltage level may be higher than the second high voltage level, and the fourth high voltage level may be higher than the third high voltage level. In such an embodiment, the second low voltage level may be lower than the first low voltage level, the third low voltage level may be lower than the second low voltage level, and the fourth low voltage level may be lower than the third low voltage level.

The amount of IR drop may increase as a length of the power line increases. A level of the gate-on voltage VON may decrease and a level of the gate-off voltage VOFF may increase as the amount of the IR drop increases. As in a conventional display apparatus, when the power supply circuit 504 generates the gate-on voltage VON having a fixed level and the gate-off voltage VOFF having a fixed level during whole frame period, the gate driving chip 314*a* may receive the gate-on voltage having a relatively high level and the gate-off voltage having a relatively low level, and the gate driving chip 344*a* may receive the gate-on voltage having a relatively low level and the gate-off voltage having a relatively high level, because the gate driving chip 314*a* has a relatively small amount of IR drop and the gate driving chip 344*a* has a relatively large amount of IR drop.

As illustrated in FIG. 7, in an exemplary embodiment of the display apparatus, the power supply circuit 504 may generate the gate-on voltage VON having a varied level by lapse of time and the gate-off voltage VOFF having a varied level by lapse of time. In one exemplary embodiment, for example, during the first period P1 during which the gate driving chip 314*a* is driven, the power supply circuit 504 may generate the gate-on voltage VON having a relatively low level and the gate-off voltage VOFF having a relatively high level. During the fourth period P4 during which the gate driving chip 344*a* is driven, the power supply circuit 504 may generate the gate-on voltage VON having a relatively high level and the gate-off voltage VOFF having a relatively low level. Thus, the IR drop of all gate driving chips 314*a*, 324*a*, 334*a* and 344*a* may be efficiently compensated.

In such an embodiment, when the gate driving chips 314*a*, 324*a*, 334*a* and 344*a* are driven in an order of a closer distance from the power supply circuit 504 (e.g., in an order of a shorter length of the power line, or in an order of a smaller amount of the IR drop), the gate-on voltage VON generated from the power supply circuit 504 may have a level that sequentially and scalariformly increases, and the gate-off voltage VOFF generated from the power supply circuit 504 may have a level that sequentially and scalariformly decreases. A swing width, which indicates a level difference between the gate-on voltage VON and the gate-off voltage VOFF generated from the power supply circuit 504, may be a first width W1, a second width W2, a third width W3 and a fourth width W4 during the first period P1, the second period P2, the third period P3 and the fourth period P4, respectively, and may sequentially increase.

In such an embodiment, although the power supply circuit 504 generates the gate-on voltage VON having a varied level by lapse of time, the gate-on voltage received by the gate driving chip 314*a* during the first period P1, the gate-on voltage received by the gate driving chip 324*a* during the second period P2, the gate-on voltage received by the gate driving chip 334*a* during the third period P3 and the gate-on voltage received by the gate driving chip 344*a* during the fourth period P4 may have a same level as each other due to the IR drop. In such an embodiment, although the power supply circuit 504 generates the gate-off voltage VOFF having a varied level by lapse of time, the gate-off voltage received by the gate driving chip 314*a* during the first period P1, the gate-off voltage received by the gate driving chip 324*a* during the second period P2, the gate-off voltage received by the gate driving chip 334*a* during the third period P3 and the gate-off voltage received by the gate driving chip 344*a* during the fourth period P4 may have the same level due to the IR drop.

In some exemplary embodiments, the level changes of the gate-on voltage VON and the gate-off voltage VOFF illustrated in FIG. 7 may be periodically repeated for each and every frame period.

Figure 8:
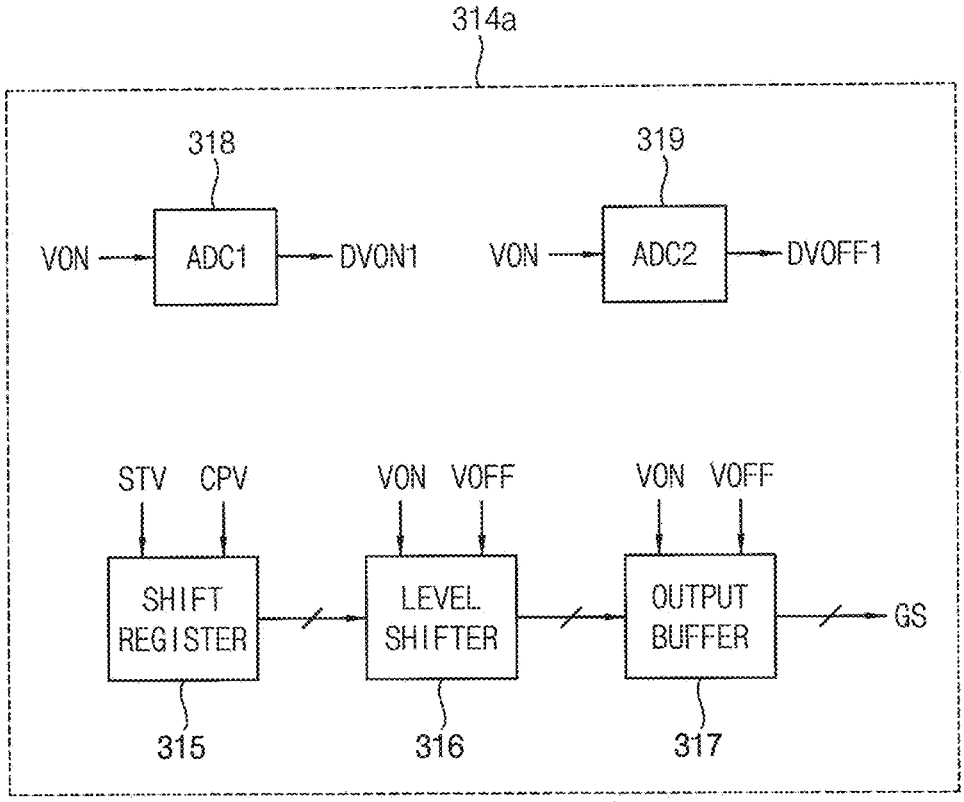
FIG. 8 is a block diagram illustrating an exemplary embodiment of a gate driving chip included in the display apparatus of FIG. 6.

FIG. 8 is a block diagram illustrating an exemplary embodiment of a gate driving chip included in the display apparatus of FIG. 6.

Referring to FIGS. 6 and 8, an exemplary embodiment of the gate driving chip 314*a* may include a shift register 315, a level shifter 316, an output buffer 317, a first analog-to-digital converter (also referred to as ADC1 in FIG. 8) 318 and a second analog-to-digital converter (also referred to as ADC2 in FIG. 8) 319.

The gate driving chip 314*a* of the display apparatus 20 of FIG. 6 may be substantially the same as the gate driving chip 310*a* of the display apparatus 10 of FIG. 1, except that the gate driving chip 314*a* of the display apparatus 20 of FIG. 6 further includes the first analog-to-digital converter 318 and the second analog-to-digital converter 319.

The shift register 315 may generate a plurality of pulses based on the vertical start signal STV and the gate clock signal CPV. The level shifter 316 may amplify levels of the plurality of pulses based on the gate-on voltage VON and the gate-off voltage VOFF. The output buffer 317 may buffer the plurality of amplified pulses based on the gate-on voltage VON and the gate-off voltage VOFF to output a gate signal GS.

The first analog-to-digital converter 318 may convert a level (e.g., the first on level) of the gate-on voltage VON at the gate driving chip 314*a* into the first digital high voltage value DVON1. The second analog-to-digital converter 319 may convert a level (e.g., the first off level) of the gate-off voltage VOFF at the gate driving chip 314*a* into the first digital low voltage value DVOFF1. In some exemplary embodiments, the first analog-to-digital converter 318 and the second analog-to-digital converter 319 may be integrated into a single analog-to-digital converter.

Although not illustrated in FIG. 8, each of the gate driving chips 324*a*, 334*a* and 344*a* included in the display apparatus 20 of FIG. 6 may have a structure substantially the same as that of the gate driving chip 314*a* of FIG. 8.

Figure 9:
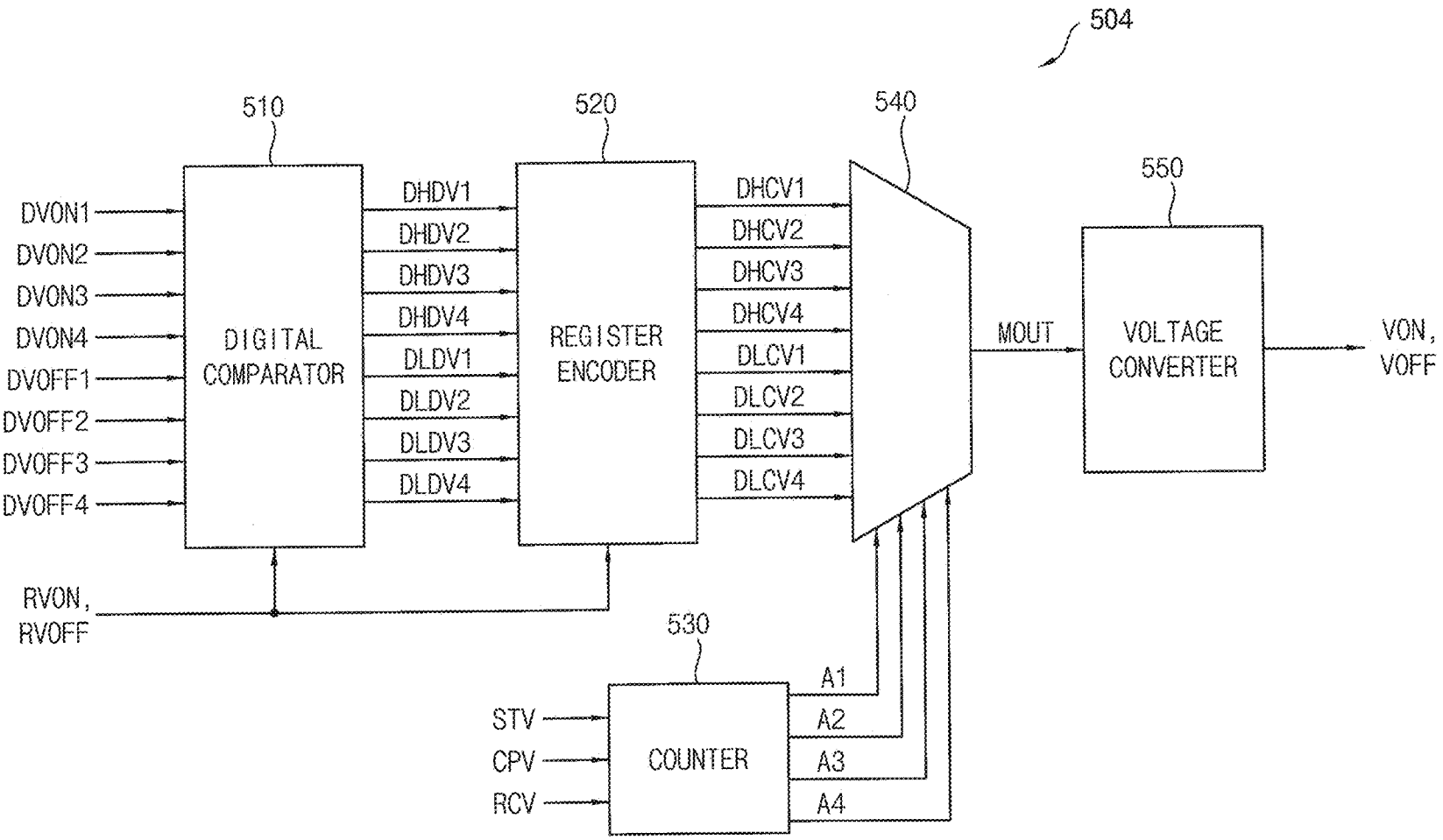
FIG. 9 is a block diagram illustrating an exemplary embodiment of a power supply circuit included in the display apparatus of FIG. 6.

FIG. 9 is a block diagram illustrating an exemplary embodiment of a power supply circuit included in the display apparatus of FIG. 6.

Referring to FIGS. 6 and 9, an exemplary embodiment of the power supply circuit 504 may include a digital comparator 510, a register encoder 520, a counter 530, a multiplexer 540 and a voltage converter 550.

The power supply circuit 504 of the display apparatus 20 of FIG. 6 may be substantially the same as the power supply circuit 500 of the display apparatus 10 of FIG. 1 except that the power supply circuit 504 of the display apparatus 20 of FIG. 6 further includes the digital comparator 510, the register encoder 520, the counter 530 and the multiplexer 540.

The digital comparator 510 may compare the first digital high voltage value DVON1 with a digital high reference value RVON to generate a first digital high difference value DHDV1, may compare the second digital high voltage value DVON2 with the digital high reference value RVON to generate a second digital high difference value DHDV2, may compare the third digital high voltage value DVON3 with the digital high reference value RVON to generate a third digital high difference value DHDV3, and may compare the fourth digital high voltage value DVON4 with the digital high reference value RVON to generate a fourth digital high difference value DHDV4. The digital comparator 510 may compare the first digital low voltage value DVOFF1 with a digital low reference value RVOFF to generate a first digital low difference value DLDV1, may compare the second digital low voltage value DVOFF2 with the digital low reference value RVOFF to generate a second digital low difference value DLDV2, may compare the third digital low voltage value DVOFF3 with the digital low reference value RVOFF to generate a third digital low difference value DLDV3, and may compare the fourth digital low voltage value DVOFF4 with the digital low reference value RVOFF to generate a fourth digital low difference value DLDV4.

The register encoder 520 may generate a first digital high compensation value DHCV1, a second digital high compensation value DHCV2, a third digital high compensation value DHCV3 and a fourth digital high compensation value DHCV4, based on the first digital high difference value DHDV1, the second digital high difference value DHDV2, the third digital high difference value DHDV3, the fourth digital high difference value DHDV4 and the digital high reference value RVON. The register encoder 520 may generate a first digital low compensation value DLCV1, a second digital low compensation value DLCV2, a third digital low compensation value DLCV3 and a fourth digital low compensation value DLCV4, based on the first digital low difference value DLDV1, the second digital low difference value DLDV2, the third digital low difference value DLDV3, the fourth digital low difference value DLDV4 and the digital low reference value RVOFF.

The counter 530 may generate a first signal A1, a second signal A2, a third signal A3 and a fourth signal A4 based on the vertical start signal STV, the gate clock signal CPV and a reference count value RCV. The first signal A1 may be activated during the first period P1, the second signal A2 may be activated during the second period P2, the third signal A3 may be activated during the third period P3, and the fourth signal A4 may be activated during the fourth period P4.

The multiplexer 540 may output one of the first digital high compensation value DHCV1, the second digital high compensation value DHCV2, the third digital high compensation value DHCV3 and the fourth digital high compensation value DHCV4 based on the first signal A1, the second signal A2, the third signal A3 and the fourth signal A4. The multiplexer 540 may output one of the first digital low compensation value DLCV1, the second digital low compensation value DLCV2, the third digital low compensation value DLCV3 and the fourth digital low compensation value DLCV4 based on the first signal A1, the second signal A2, the third signal A3 and the fourth signal A4.

The voltage converter 550 may generate the gate-on voltage VON and the gate-off voltage VOFF based on an output MOUT of the multiplexer 540. In such an embodiment, as described above with reference to FIG. 7, the gate-on voltage VON generated from the voltage converter 550 may have the first high voltage level during the first period P1, the second high voltage level during the second period P2, the third high voltage level during the third period P3 and the fourth high voltage level during the fourth period P4 (e.g., may have a level that sequentially and scalariformly increases). The gate-off voltage VOFF generated from the voltage converter 550 may have the first low voltage level during the first period P1, the second low voltage level during the second period P2, the third low voltage level during the third period P3 and the fourth low voltage level during the fourth period P4 (e.g., may have a level that sequentially and scalariformly decreases).

Hereinafter, an operation of generating the gate-on voltage VON will be described in greater detail.

Figure 12:
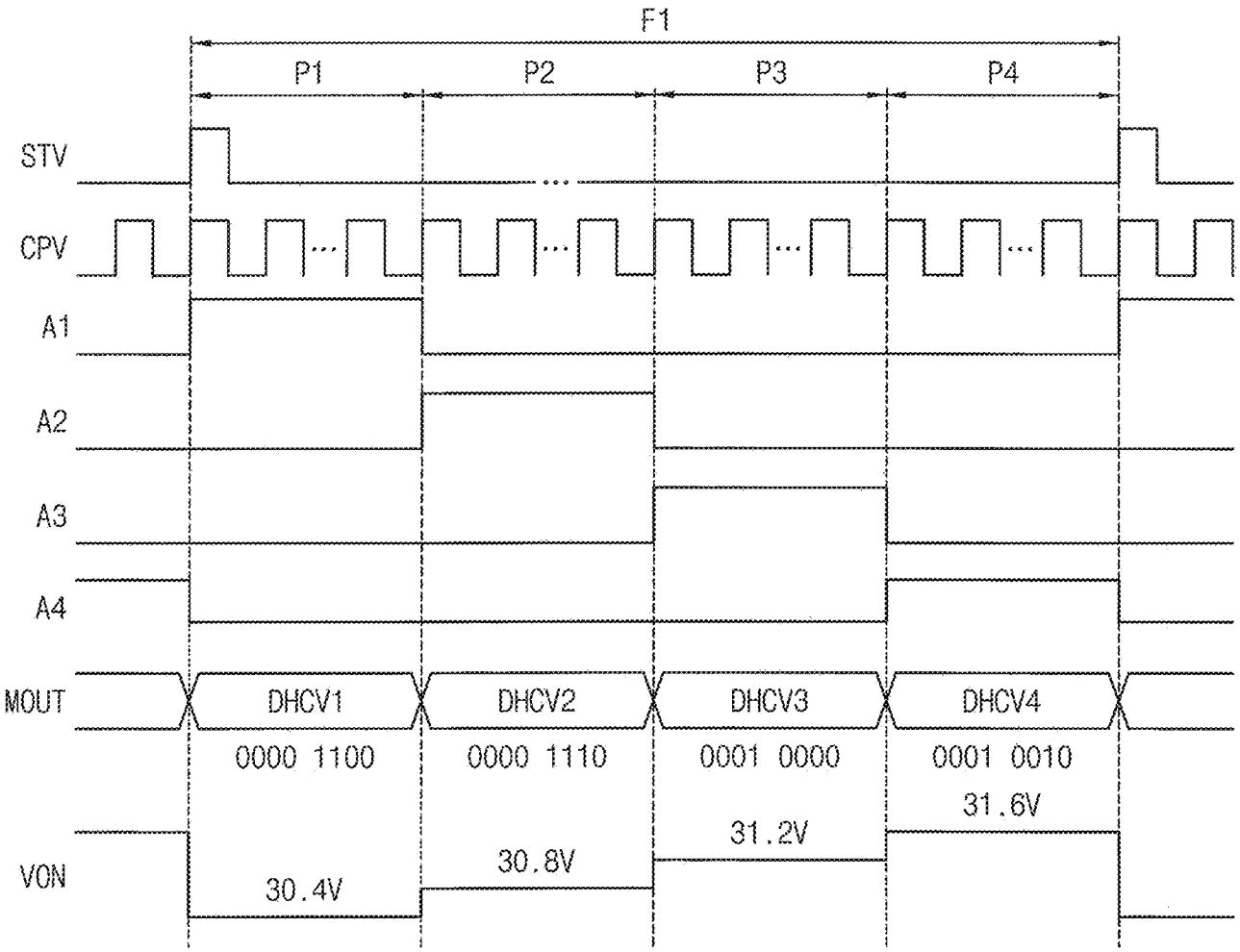

FIGS. 10, 11A, 11B and 12 are diagrams for describing an operation of the power supply circuit of FIG. 9. FIG. 10 illustrates an exemplary embodiment of a lookup table. FIGS. 11A and 11B illustrate an exemplary embodiment of inputs of the digital comparator 510 and an exemplary embodiment of outputs of the register encoder 520, respectively. FIG. 12 illustrates overall operations of an exemplary embodiment of the power supply circuit 504.

Referring to FIGS. 6, 9, 10, 11A, 11B and 12, the digital comparator 510 may generate the first digital high difference value DHDV1, the second digital high difference value DHDV2, the third digital high difference value DHDV3 and the fourth digital high difference value DHDV4 based on a lookup table that is predetermined and prestored.

In one exemplary embodiment, for example, a target level of the gate-on voltage VON may be about 30 V, and the digital high reference value RVON that indicates the target level of the gate-on voltage VON may be set to "00001010" based on the lookup table of FIG. 10.

At an initial operation time, levels of the gate-on voltage VON at the gate driving chips 314*a*, 324*a*, 334*a* and 344*a* may be about 29.6 V, about 29.2 V, about 28.8 V and about 28.4 V, respectively. In other words, voltage drops of about 0.4 V, about 0.8 V, about 1.2 V and about 1.6 V may occur while the gate-on voltage VON is provided from the power supply circuit 504 to the gate driving chips 314*a*, 324*a*, 334*a* and 344*a*, respectively. The gate driving chips 314*a*, 324*a*, 334*a* and 344*a* may convert the levels of the received gate-on voltage VON into the first, second, third and fourth digital high voltage values DVON1, DVON2, DVON3 and DVON4, respectively. In one exemplary embodiment, for example, the first, second, third and fourth digital high voltage values DVON1, DVON2, DVON3 and DVON4 may be set to "00001000," "00000110," "00000100" and "00000010," respectively, based on the lookup table of FIG. 10.

The digital comparator 510 may generate the first, second, third and fourth digital high difference values DHDV1, DHDV2, DHDV3 and DHDV4, each of which indicates a difference between the digital high reference value RVON and a respective one of the first, second, third and fourth digital high voltage values DVON1, DVON2, DVON3 and DVON4.

The register encoder 520 may generate the first digital high compensation value DHCV1, the second digital high compensation value DHCV2, the third digital high compensation value DHCV3 and the fourth digital high compensation value DHCV4 based on the lookup table of FIG. 10.

In one exemplary embodiment, for example, the register encoder 520 may generate the first, second, third and fourth digital high compensation value DHCV1, DHCV2, DHCV3 and DHCV4 by adding the digital high reference value RVON to the first, second, third and fourth digital high difference values DHDV1, DHDV2, DHDV3 and DHDV4, respectively. In one exemplary embodiment, for example, the first, second, third and fourth digital high compensation value DHCV1, DHCV2, DHCV3 and DHCV4 may be set to "00001100," "00001110," "00010000" and "00010010," respectively.

As illustrated in FIG. 12, the counter 530 may activate the first signal A1 during the first period P1 by counting the gate clock signal CPV based on the reference count value RCV and the vertical start signal STV (e.g., by counting the gate clock signal CPV by the reference count value RCV in response to an activation or a rising edge of the vertical start signal STV). The counter 530 may activate the second signal A2 during the second period P2 by counting the gate clock signal CPV based on the reference count value RCV and the first signal A1 (e.g., by counting the gate clock signal CPV by the reference count value RCV in response to a deactivation or a falling edge of the first signal A1). The counter 530 may activate the third signal A3 during the third period P3 by counting the gate clock signal CPV based on the reference count value RCV and the second signal A2 (e.g., by counting the gate clock signal CPV by the reference count value RCV in response to a deactivation or a falling edge of the second signal A2). The counter 530 may activate the fourth signal A4 during the fourth period P4 by counting the gate clock signal CPV based on the reference count value RCV and the third signal A3 (e.g., by counting the gate clock signal CPV by the reference count value RCV in response to a deactivation or a falling edge of the third signal A3).

The multiplexer 540 may output the first digital high compensation value DHCV1 based on the first signal A1 during the first period P1, may output the second digital high compensation value DHCV2 based on the second signal A2 during the second period P2, may output the third digital high compensation value DHCV3 based on the third signal A3 during the third period P3, and may output the fourth digital high compensation value DHCV4 based on the fourth signal A4 during the fourth period P4. Thus, in such an embodiment, the voltage converter 550 may generate the gate-on voltage VON having a level that sequentially and scalariformly increases, as illustrated in FIGS. 7 and 12.

Accordingly, each of the gate driving chips 314*a*, 324*a*, 334*a* and 344*a* may receive the gate-on voltage VON having the target level (e.g., about 30 V) during a respective one of the first, second, third and fourth periods P1, P2, P3 and P4.

Although not illustrated in FIGS. 10, 11A, 11B and 12, an operation of generating the gate-off voltage VOFF may be similar to the operation of generating the gate-on voltage VON. In one exemplary embodiment, for example, a target level of the gate-off voltage VOFF may be about −10 V. The digital low reference value RVOFF, the digital low voltage values DVOFF1, DVOFF2, DVOFF3 and DVOFF4, the digital low difference values DLDV1, DLDV2, DLDV3 and DLDV4, and the digital low compensation values DLCV1, DLCV2, DLCV3 and DLCV4 may be set based on a lookup table for the gate-off voltage VOFF. The voltage converter 550 may generate the gate-off voltage VOFF having a level that sequentially and scalariformly decreases, as illustrated in FIG. 7.

In exemplary embodiments of the display apparatus and the display panel driving circuit thereof, as described with reference to FIGS. 6 through 12, the IR drop of the gate-on voltage VON and the gate-off voltage VOFF may be efficiently sensed or detected by the gate driving chips 314*a*, 324*a*, 334*a* and 344*a* and the power supply circuit 504, the amount of the IR drop may be provided as a digital value, and thus the gate-on voltage VON and the gate-off voltage VOFF may be efficiently and objectively compensated. In such embodiments, the IR drop may be compensated to comply with a characteristic and/or a performance of the gate driving chip. Further, charging rate of the pixels PX may be improved.

According to exemplary embodiments, an operation of sensing and compensating the IR drop described with reference to FIGS. 6 through 12 may be performed once during a manufacturing process of the display apparatus, or may be repeatedly performed when the display apparatus is initialized.

Although exemplary embodiments, where the feedback lines FPL1, FPL2, FPL3 and FPL4 are connected to the first gate driving circuit 304*a* that is disposed at the first side (e.g., the left side) of the display panel 100, has been described in detail for convenience of description, but not being limited thereto. Alternatively, feedback lines may be connected to a gate driving circuit that is disposed at a second side (e.g., a right side) of a display panel, or feedback lines may be connected to gate driving circuits that are disposed at both sides of a display panel.

Although exemplary embodiments, where both the gate-on voltage VON and the gate-off voltage VOFF are compensated, has been described in detail for convenience of description, but not being limited thereto. Alternatively, only the gate-on voltage VON may be compensated, or only the gate-off voltage VOFF may be compensated. In some exemplary embodiments, where one gate-on voltage and two different gate-off voltages may be used for driving the display apparatus, one gate-on voltage and one gate-off voltage may be compensated.

Figure 13:
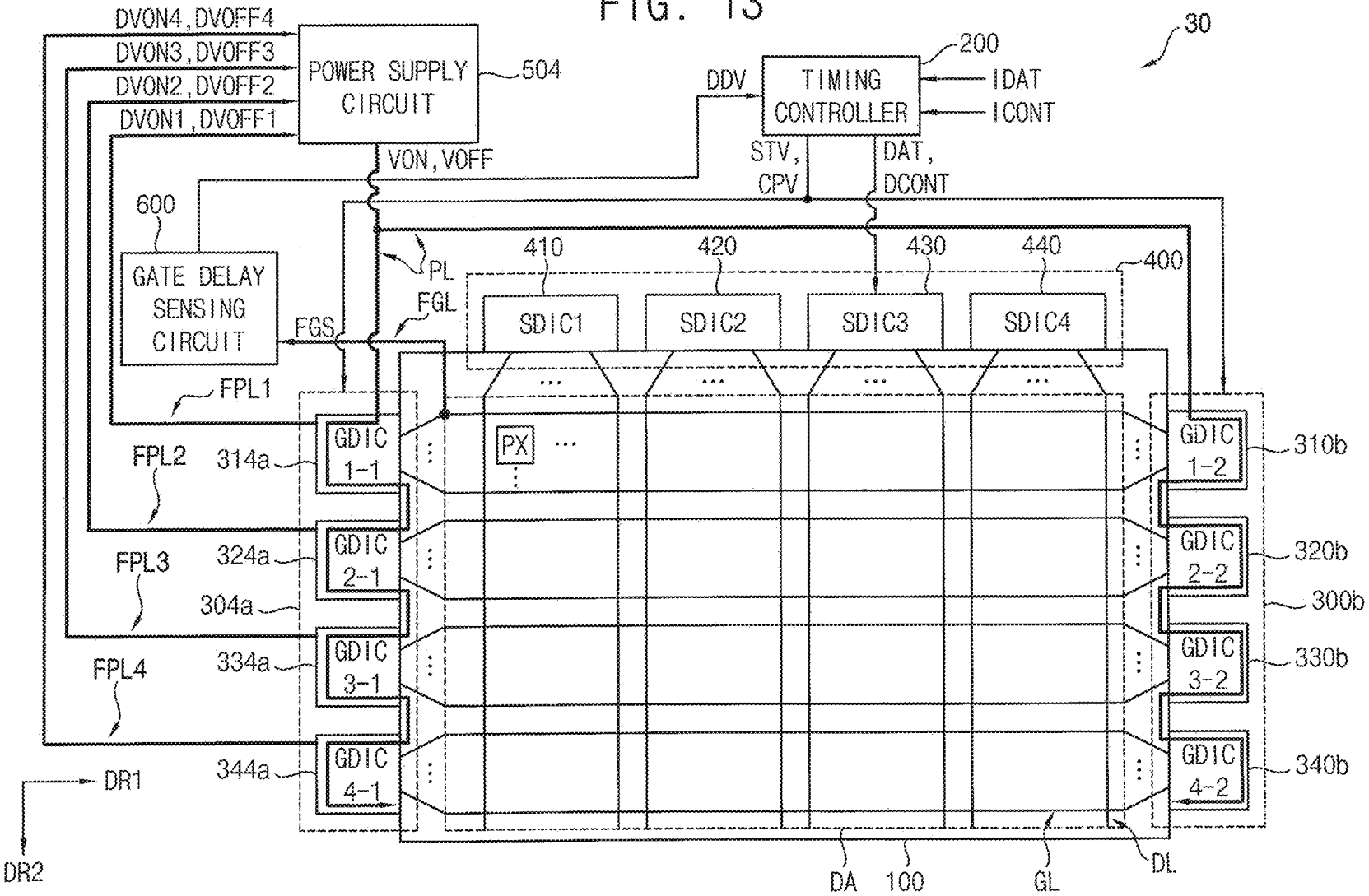
FIG. 13 is a block diagram illustrating a display apparatus according to another alternative exemplary embodiment.

FIG. 13 is a block diagram illustrating a display apparatus according to another alternative exemplary embodiment.

Referring to FIG. 13, an exemplary embodiment of a display apparatus 30 includes a display panel 100 and a display panel driving circuit. The display panel driving circuit includes a power supply circuit 504, first and second gate driving circuits 304*a* and 300*b*, a gate delay sensing circuit 600, feedback lines FGL, FPL1, FPL2, FPL3 and FPL4, and a power line PL. The display panel driving circuit may further include a timing controller 200 and a data driving circuit 400.

The display apparatus 30 of FIG. 13 may be implemented by integrating the display apparatus 10 of FIG. 1 with the display apparatus 20 of FIG. 6. In one exemplary embodiment, for example, the display panel 100, the timing controller 200, the second gate driving circuit 300*b*, the data driving circuit 400, the gate delay sensing circuit 600 and the feedback line FGL in FIG. 13 may be substantially the same as the display panel 100, the timing controller 200, the second driving circuit 300*b*, the data driving circuit 400, the gate delay sensing circuit 600 and the feedback line FGL in FIG. 1, respectively. The power supply circuit 504, the first gate driving circuit 304*a*, the feedback lines FPL1, FPL2, FPL3 and FPL4 and the power line PL in FIG. 13 may be substantially the same as the power supply circuit 504, the first gate driving circuit 304*a*, the feedback lines FPL1, FPL2, FPL3 and FPL4 and the power line PL in FIG. 6, respectively.

In some exemplary embodiments, each of the display apparatus 10 of FIG. 1, the display apparatus 20 of FIG. 6 and the display apparatus 30 of FIG. 13 may further include a printed circuit board ("PCB") and a flexible PCB ("FPCB"), and at least a part of the display panel driving circuit may be disposed, e.g., directly mounted, on the PCB and the FPCB. In alternative exemplary embodiments, at least a part of the display panel driving circuit may be integrated on the peripheral region of the display panel 100.

Although the exemplary embodiments where the display apparatus includes a specific number of the gate driving chips and a specific number of the feedback lines, have been described for convenience of description, but not being limited thereto. Alternatively, a display apparatus may include any number of gate driving chips and any number of feedback lines.

The above described embodiments may be used in a display apparatus and/or a system including the display apparatus, such as a mobile phone, a smart phone, a personal digital assistant ("PDA"), a portable multimedia player ("PMP"), a digital camera, a digital television, a set-top box, a music player, a portable game console, a navigation device, a personal computer ("PC"), a server computer, a workstation, a tablet computer, a laptop computer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display apparatus comprising:

a display panel including a plurality of first gate lines and a plurality of second gate lines;

a power supply circuit which generates a gate-on voltage;

a first gate driver which drives the plurality of first gate lines based on the gate-on voltage and converts a first on level of the gate-on voltage at the first gate driver into a first digital high voltage value;

a second gate driver which drives the plurality of second gate lines based on the gate-on voltage and converts a second on level of the gate-on voltage at the second gate driver into a second digital high voltage value;

a first feedback line which provides the first digital high voltage value to the power supply circuit; and a second feedback line which provides the second digital high voltage value to the power supply circuit, wherein the power supply circuit generates the gate-on voltage having a first high voltage level based on the first digital high voltage value during a first period, during which the plurality of first gate lines are driven, and wherein the power supply circuit generates the gate-on voltage having a second high voltage level based on the second digital high voltage value during a second period, during which the plurality of second gate lines are driven, wherein the second high voltage level is different from the first high voltage level.

2. The display apparatus of claim 1, wherein the power supply circuit includes:

a digital comparator which compares the first digital high voltage value with a digital high reference value to generate a first digital high difference value and compares the second digital high voltage value with the digital high reference value to generate a second digital high difference value;

a register encoder which generates a first digital high compensation value and a second digital high compensation value based on the first digital high difference value, the second digital high difference value and the digital high reference value;

a counter which generates a first signal and a second signal based on a reference count value, wherein the first signal is activated during the first period, and the second signal is activated during the second period;

a multiplexer which outputs one of the first digital high compensation value and the second digital high compensation value based on the first signal and the second signal; and a voltage converter which generates the gate-on voltage based on an output of the multiplexer, wherein the gate-on voltage has the first high voltage level during the first period and has the second high voltage level during the second period.

3. The display apparatus of claim 2, wherein the register generates the first digital high compensation value and the second digital high compensation value based on a predetermined lookup table.

4. The display apparatus of claim 2, wherein the counter counts a gate clock signal based on a vertical start signal and the reference count value to activate the first signal during the first period, and the counter counts the gate clock signal based on the first signal and the reference count value to activate the second signal during the second period.

5. The display apparatus of claim 2, wherein the multiplexer outputs the first digital high compensation value based on the first signal during the first period, and the multiplexer outputs the second digital high compensation value based on the second signal during the second period.

6. The display apparatus of claim 1, wherein the first gate driver is located closer to the power supply circuit than the second gate driver, and the second high voltage level is higher than the first high voltage level.

7. The display apparatus of claim 1, wherein the power supply circuit further generates a gate-off voltage, the first gate driver drives the plurality of first gate lines based on the gate-on voltage and the gate-off voltage and further converts a first off level of the gate-off voltage at the first gate driver into a first digital low voltage value, the second gate driver drives the plurality of second gate lines based on the gate-on voltage and the gate-off voltage and converts a second off level of the gate-off voltage at the second gate driver into a second digital low voltage value, the first digital low voltage value and the second digital low voltage value are provided to the power supply circuit, the power supply circuit generates the gate-off voltage having a first low voltage level based on the first digital low voltage value during the first period, and the power supply circuit generates the gate-off voltage having a second low voltage level based on the second digital low voltage value during the second period, wherein the second low voltage level is different from the first low voltage level.

8. The display apparatus of claim 7, wherein the first gate driver is located closer to the power supply circuit than the second gate driver, and the second low voltage level is lower than the first low voltage level.

9. The display apparatus of claim 1, wherein each of the first gate driver and the second gate driver includes an analog-to-digital converter.

10. The display apparatus of claim 1, wherein the display panel further includes:

a plurality of pixels connected to the plurality of first gate lines and the plurality of second gate lines; and a plurality of data lines connected to the plurality of pixels.

* * * * *